US009634408B2

(12) United States Patent
Koepsell

(10) Patent No.: US 9,634,408 B2
(45) Date of Patent: Apr. 25, 2017

(54) ELECTRICAL CIRCUIT ARRANGEMENT HAVING A TERMINAL ON A FLEXIBLE SHEET DISPOSED BETWEEN A SUPPORT LAYER AND A COUNTER CONTACT

(71) Applicant: Johnson Electric S.A., Murten (CH)

(72) Inventor: Martin Koepsell, Ennepetal (DE)

(73) Assignee: JOHNSON ELECTRIC S.A., Murten (CH)

( * ) Notice: Subject to any disclaimer, the term of this patent is extended or adjusted under 35 U.S.C. 154(b) by 0 days.

(21) Appl. No.: 14/296,005

(22) Filed: Jun. 4, 2014

(65) Prior Publication Data

US 2014/0357102 A1 Dec. 4, 2014

(30) Foreign Application Priority Data

Jun. 4, 2013 (DE) ..... 10 2013 009 309

(51) Int. Cl.

| | |
|---|---|
| ***H01R 12/00*** | (2006.01) |
| ***H01R 12/61*** | (2011.01) |
| ***H01R 12/78*** | (2011.01) |
| ***H01R 12/91*** | (2011.01) |
| *H01R 12/70* | (2011.01) |

(52) U.S. Cl.

CPC ..... *H01R 12/61* (2013.01); *H01R 12/613* (2013.01); *H01R 12/78* (2013.01); *H01R 12/91* (2013.01); *H01R 12/7088* (2013.01)

(58) Field of Classification Search

CPC ..... H01R 12/59–12/62; H01R 12/613

USPC ..... 439/77–84, 59, 60, 67, 492–499

See application file for complete search history.

(56) References Cited

U.S. PATENT DOCUMENTS

| | | | | | |
|---|---|---|---|---|---|
| 3,188,601 | A * | 6/1965 | De Tar | H01R 12/774 | 439/328 |
| 4,684,183 | A * | 8/1987 | Kinoshita et al. | 439/77 | |
| 4,927,387 | A * | 5/1990 | Eckler et al. | 439/499 | |
| 5,386,344 | A * | 1/1995 | Beaman et al. | 361/785 | |
| 5,427,537 | A * | 6/1995 | Savovic | H01M 2/1055 | 439/495 |
| 5,452,182 | A * | 9/1995 | Eichelberger et al. | 361/749 | |
| 5,598,627 | A * | 2/1997 | Saka et al. | 29/861 | |
| 6,000,591 | A * | 12/1999 | Alexander | 224/257 | |
| 6,232,791 | B1 * | 5/2001 | Jitsumori | G01R 31/2886 | 324/754.08 |
| 6,407,563 | B2 * | 6/2002 | Ohtaki | G01R 31/2863 | 324/754.08 |
| 6,514,089 | B2 * | 2/2003 | Satou | H05K 3/365 | 439/493 |
| 2013/0269987 | A1 * | 10/2013 | Koepsell | 174/252 | |

* cited by examiner

*Primary Examiner* — Chandrika Prasad

(74) *Attorney, Agent, or Firm* — Muncy, Geissler, Olds & Lowe, P.C.

(57) ABSTRACT

In an electrical circuit with at least one flexible sheet element with electrical conductor tracks, at least one terminal arrangement for connection to a power supply and/or for data transmission, provision is made for the terminal to be formed by a portion of the sheet element with exposed conductor tracks, against which counter-contacts are positioned.

17 Claims, 3 Drawing Sheets

ELECTRICAL CIRCUIT ARRANGEMENT HAVING A TERMINAL ON A FLEXIBLE SHEET DISPOSED BETWEEN A SUPPORT LAYER AND A COUNTER CONTACT

CROSS REFERENCE TO RELATED APPLICATIONS

This non-provisional patent application claims priority under 35 U.S.C. §119(a) from Patent Application No. 102013009309.0 filed in Germany on Jun. 4, 2013, the entire contents of which are hereby incorporated by reference.

FIELD OF THE INVENTION

The invention relates to a terminal arrangement for an electrical circuit with at least one flexible sheet element with electrical conductor tracks, for connection to a power supply and/or a data transmission.

BACKGROUND OF THE INVENTION

Circuit arrangements with flexible sheet elements can replace circuit boards. The sheet elements comprise electrical conductor tracks, and modules can be brought into contact with the conductor tracks on such flexible sheet elements and be arranged on the sheet elements. The flexible sheet element of such a circuit arrangement requires a terminal for connection to a power supply for operating the modules.

In the art electrical terminal lines are connected via two-part plug-in connectors with the sheet element by means of an associated separate plug-in operation. One contact side is, as a rule, implemented as a fixed metal tongue or as a metallized region on a foil with (printed) electrical conductor tracks forming the flexible sheet element. The second contact side is, as a rule, implemented as a metal spring which is electrically connected with a terminal line and is embedded into a plastic housing. With the plug-in operation a mechanical lock is often effected between the two plug parts.

The plug-in connectors are additional components which must be manufactured in working operations and must be connected to the flexible sheet element.

Flexible sheet elements with electrical conductor tracks (foils) can comprise a plurality of electrical and mechanical functions. Sheet elements with electrical conductor tracks must be connected with electrical lines for voltage supply and/or data exchange. The flexible sheet elements are, as a rule, mounted into rigid carrier elements. Usually electrical contacting is achieved using plugs as described above. One plug part is attached to the electrical supply line, a second plug part is attached to the sheet element to be contacted such as a foil. Electrical contacting is carried out in a separate assembly step. The completed carrier is then fastened mechanically in the application. This mechanical installation constitutes a second assembly step. Commonly known plug-in systems are expensive and are manufactured by companies specializing in this field.

SUMMARY OF THE INVENTION

Hence there is a desire for a simple terminal arrangement for an electrical circuit for connection of a power supply and/or data transmission system.

According to the invention this requirement is met in that the terminal is formed by a portion of the sheet element with exposed conductor tracks, against which the counter-contacts are positioned.

The terminal for the power supply of the flexible sheet element according to the invention is formed by utilizing the sheet element itself. The electrical conductor tracks present in the sheet element are exposed so that one component of an electrical contact already exists. Another component for the contact, i.e. a counter-contact, is positioned against these conductor tracks, thus an electrical connection is established making it possible to introduce an electrical voltage/current into the conductor tracks of the sheet element. Plug components may thus be advantageously omitted, the power supply for the flexible sheet element for example is simplified, and there is no longer any need for working steps to manufacture the power supply.

According to a first further development of the invention provision is made for a support layer to be associated with the portion with the exposed conductor tracks. The support layer stabilizes the portion with the exposed conductor tracks so that counter-contacts can be placed with a certain pressure against the conductor tracks. The counter-contacts do not push the conductor tracks away, rather, because they are positioned under pressure, safe contacting of the conductor tracks and counter-contacts is achieved. The support layer may be, for example, a leaf spring. The leaf spring, after it has been assembled, may for example be provided with an indentation. The leaf spring, for example, may be formed from a metal, but a flexible foil may be used just as well for this purpose.

Alternatively the support layer may be formed of a body made from a resiliently deformable material, for example from a synthetic rubber layer. The support layer may be firmly connected to the portion with the exposed conductor tracks, for example by gluing or laminating.

In order to further improve contacting between conductor tracks and counter-contacts provision is made in a further development of the invention for the counter-contacts to have a structural shape which deflects the support layer. The counter-contacts are thus used to effect an actual deflection of the support layer, so that the exposed conductor tracks of the foil for example are then located between counter-contacts and support layer. This supports safe contacting.

Alternatively provision may be made for the counter-contacts themselves to be somewhat point-shaped and to be inserted into a contact holder deflecting the support layer. The contact holder then deflects the support layer, whereby the counter-contacts are pressed onto the exposed conductor tracks. Due to the counter-contacts being point-shaped tolerance compensation can be achieved at the same time, the conductor tracks may be made correspondingly wider so that even when tolerances occur during the association of counter-contacts and conductor tracks, safe contacting is always achieved.

The contact holder deflecting the support layer may for example comprise a bulbous shape which enables the support layer formed e.g. as a leaf spring to bulge out.

Electrical connection and mechanical attachment in the application is effected in an assembly step. The contact areas are dimensioned in such a way that assembly tolerances of the components are compensated for. Both sides of the contact connection can be attached independently. Positional tolerances of the associated contact zones arising therefrom are compensated for by corresponding dimensioning. The flexible sheet element with associated support layer is the sole flexible component for establishing the contact. Only sheet-like components are used for contacting. Pre-shaped springs and the assembly thereof are avoided, and established methods for the mass-production of foil conductor tracks may be utilized for their manufacture. Advantageously a low structural height is obtained, the contact region is constructed so as to be sealed in a simple manner. Plugs as additional components are avoided.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
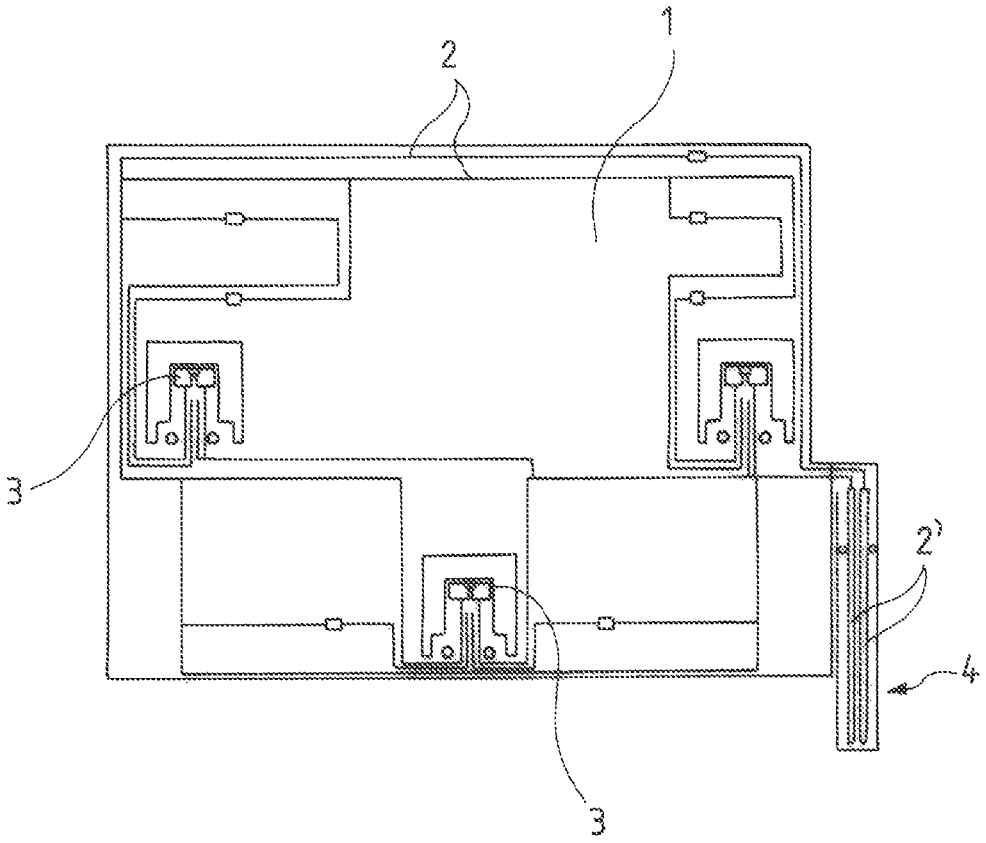
FIG. 1 shows a top view of a flexible sheet element with electrical conductor tracks, in accordance with the preferred embodiment of the present invention.

FIG. 1 illustrates a flexible sheet element configured as a foil 1. The foil 1 comprises electrical conductor tracks 2, and has components 3 arranged on it.

The foil 1 is equipped with a terminal 4 representing the power supply to supply the components 3. The terminal 4 shows the contacts associated with the foil 1 for forming a terminal, these contacts are shaped in the form of exposed, i.e. stripped conductor tracks 2'. The terminal is formed by the exposed stripped conductor tracks 2'.

Figure 2:
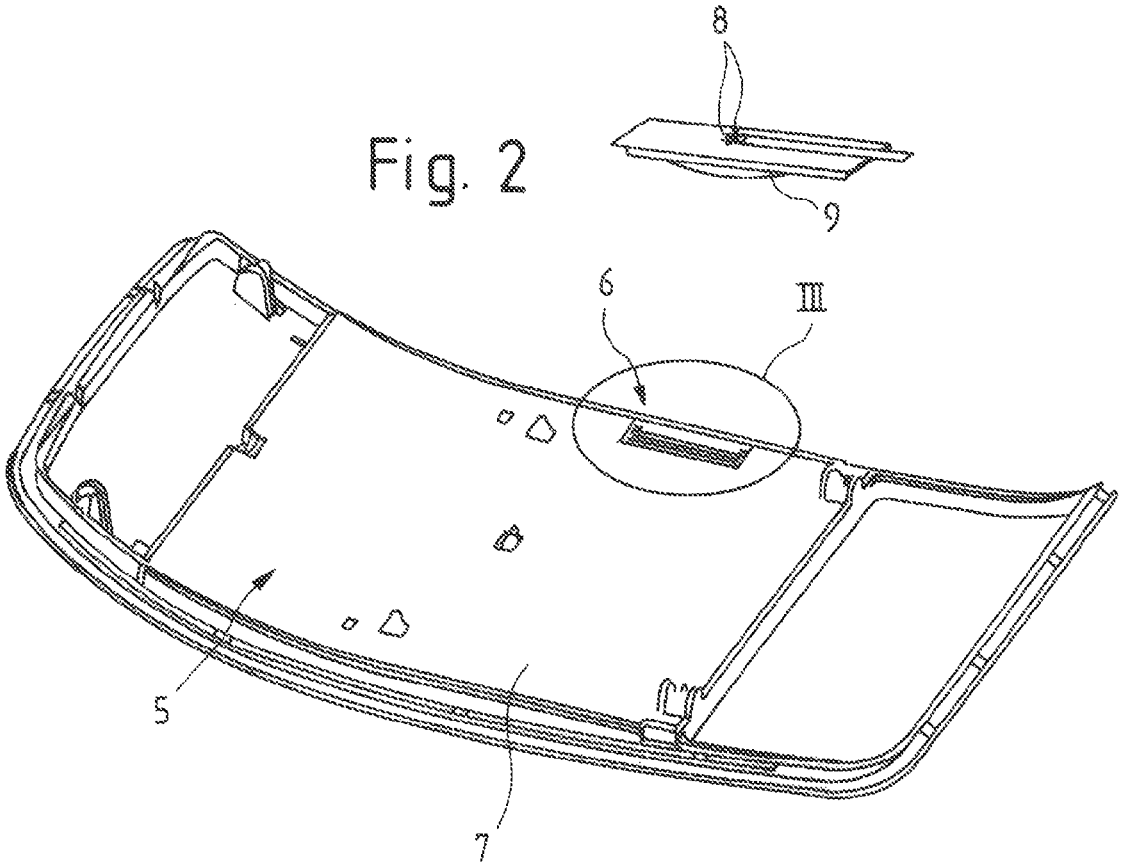
FIG. 2 shows a perspective view of a component into which the flexible sheet element has been fitted.
Figure 3:
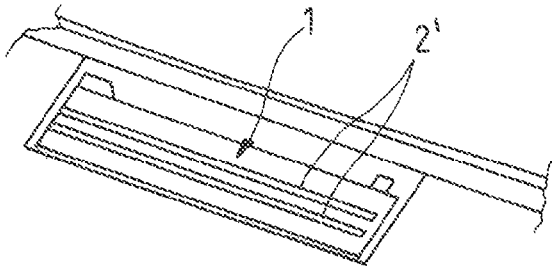
FIG. 3 shows an enlarged view of the detail III in FIG. 2.

FIG. 2 shows that in the component shaped as a housing 5 a break-through or cut-out 6 is arranged within a wall 7, this cut-out 6 is located at that portion of foil 1 in which the exposed conductor tracks 2' are arranged. FIG. 3 illustrates the cut-out on an enlarged scale.

Figure 4:
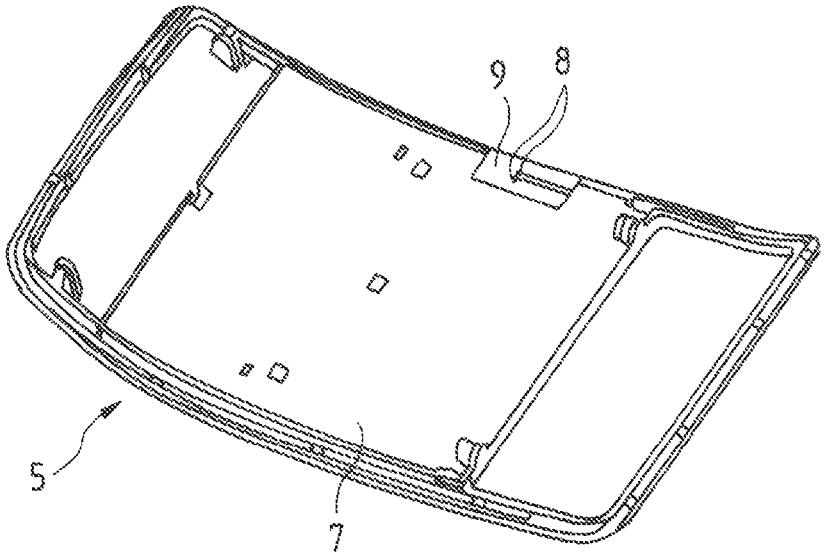
FIG. 4 shows a further perspective view of the component of FIG. 2 after assembling the electrical circuit arrangement.

FIG. 2 also shows counter-contacts 8 which are arranged in a bulbous contact holder 9. This contact holder 9 is inserted into the break-through 6 as shown in FIG. 4. The counter-contacts 8 are placed onto the stripped conductor tracks 2', and this is how contact is established.

Figure 5:
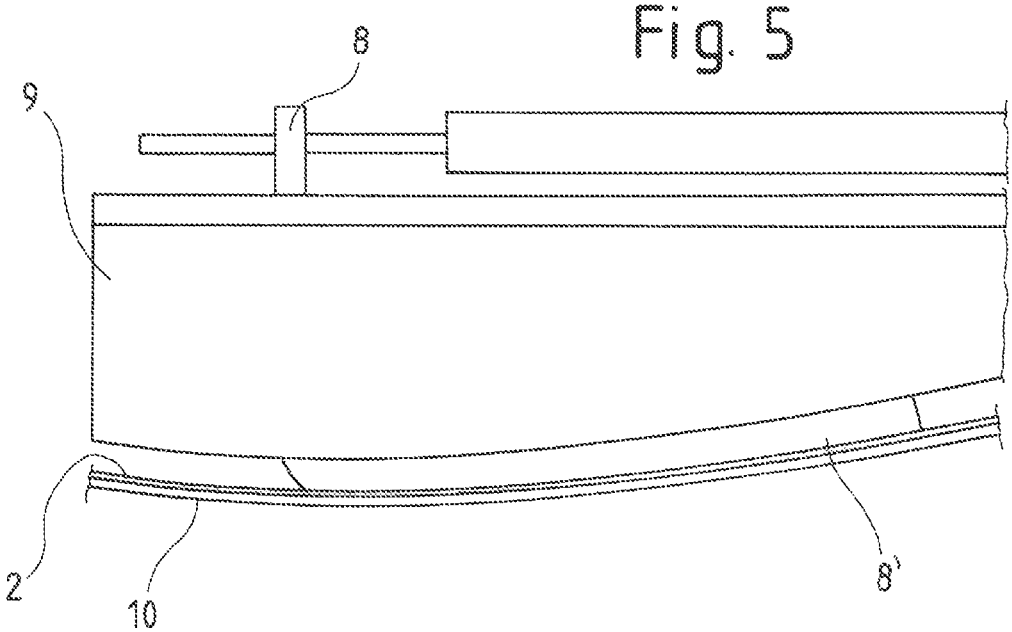
FIG. 5 shows an enlarged side view, drawn to scale, of components for the terminal arrangement for connecting the power supply to the flexible sheet element of FIG. 1.

As can be seen in FIG. 5 the counter-contacts 8 pass through the contact holder 9 and are arranged along a surface area of the contact holder 9. The portions 8' of the counter-contacts 8 are lying on the bulbous surface of the contact holder 9, and the stripped conductor tracks 2' are positioned against these portions 8'. Positioning is effected by bringing the contact holder 9 to the housing 5, as shown in FIG. 2. Thus the portions 8' of the counter-contacts 8 are brought to the stripped conductor tracks 2', and this, due to the bulbous shape of the contact holder 9, leads to a relative movement between the portions 8' and the stripped conductor tracks 2'. Advantageously this causes a certain friction to be applied to the conductor tracks 2, wherein the frictional movement provides a wiping affect whereby oxidations or other particles such as dust can be removed. The stripped conductor tracks 2' are completely disposed below the at least one counter contact 8.

The foil 1 with the stripped conductor tracks 2' is supported by a support layer 10 in the region where the counter-contacts 8 are placed. This support layer 10 comprises a resiliently deformable or elastic material and may be a leaf spring, for example. This material is deflected due to contact with the contact portions 8' of the contact holder 9, and this causes the stripped conductor tracks 2' to be resiliently pressed against the portions 8'.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. An electrical circuit arrangement, which comprises:
at least one flexible sheet element including:
a planar support layer; and
at least one terminal for power supply and/or data transmission connection directly disposed entirely on the planar support layer,
wherein the at least one terminal is formed by exposed stripped conductor tracks of the flexible sheet element against which at least one counter contact is positioned such that the at least one terminal is disposed between the planar support layer and the at least one counter contact, the exposed stripped conductor tracks are completely disposed below the at least one counter contact.

2. The circuit arrangement of claim 1, further comprising:
a contact holder, wherein a surface of the contact holder supports the at least one counter contact.

3. The circuit arrangement of claim 1, wherein the planar support layer is a leaf spring.

4. The circuit arrangement of claim 3, wherein the at least one counter contact has a structural shape deflecting the support layer.

5. The circuit arrangement of claim 2, wherein the contact holder has a bulbous structural shape.

6. The circuit arrangement of claim 3, wherein the at least one counter contact is inserted into a contact holder that directly deforms the support layer.

7. The circuit arrangement of claim 2, wherein the support layer is a body of resiliently deformable material.

8. The circuit arrangement of claim 7, wherein the at least one counter contact has a structural shape that deforms the support layer.

9. The circuit arrangement of claim 7, wherein the contact holder has a bulbous structural shape.

10. The circuit arrangement of claim 7, wherein the at least one counter contact is inserted into a contact holder that deforms the support layer.

11. The circuit arrangement of claim 2, wherein a first plane of the at least one sheet element and a second plane of the contact holder are substantially parallel.

12. The circuit arrangement of claim 2, further comprising:

a housing enclosing the at least one flexible sheet element, and including an opening for receiving the contact holder.

13. The circuit arrangement of claim 9, wherein the at least one counter contact extends from the contact holder.

14. The circuit arrangement of claim 2, wherein an elongated portion of the at least one counter contact is in direct contact with the at least one terminal.

15. The circuit arrangement of claim 2, wherein the at least one counter contact passes through two opposites surfaces of the contact holder, and are arranged along a surface area of the contact holder.

16. The circuit arrangement of claim 15, wherein portions of the counter contact are lying on a bulbous surface of the contact holder, and the stripped conductor tracks are positioned against the portions.

17. The circuit arrangement of claim 1, wherein the planar support layer is disposed completely below a lower surface of the stripped conductor tracks.

* * * * *